US008337052B2

(12) United States Patent
Zhang et al.

(10) Patent No.: US 8,337,052 B2
(45) Date of Patent: Dec. 25, 2012

(54) LED LAMP INCORPORATING AN ELONGATED LENS USED FOR DIRECTING EMITTED LIGHT WITHIN A PREDETERMINED RANGE OF ANGLES

(75) Inventors: Hai-Wei Zhang, Shenzhen (CN); Jia-Chuan Lv, Shenzhen (CN); Chin-Chung Chen, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 486 days.

(21) Appl. No.: 12/638,949

(22) Filed: Dec. 15, 2009

(65) Prior Publication Data

US 2011/0090701 A1 Apr. 21, 2011

(30) Foreign Application Priority Data

Oct. 15, 2009 (CN) ..... 2009 1 0308311

(51) Int. Cl.
*F21V 3/02* (2006.01)
*F21V 5/04* (2006.01)

(52) U.S. Cl. ..... 362/311.02; 362/311.06; 362/311.08; 362/311.09

(58) Field of Classification Search . 362/311.01–311.15
See application file for complete search history.

(56) References Cited

U.S. PATENT DOCUMENTS

| | | | | |
|---|---|---|---|---|
| 6,296,376 | B1 * | 10/2001 | Kondo et al. | 362/311.02 |
| 7,329,029 | B2 * | 2/2008 | Chaves et al. | 362/311.06 |
| 7,348,723 | B2 * | 3/2008 | Yamaguchi et al. | 313/501 |
| 7,422,347 | B2 * | 9/2008 | Miyairi et al. | 362/335 |
| 2006/0083000 | A1 * | 4/2006 | Yoon et al. | 362/311 |
| 2008/0013322 | A1 * | 1/2008 | Ohkawa | 362/311 |

* cited by examiner

*Primary Examiner* — Mariceli Santiago
(74) *Attorney, Agent, or Firm* — Altis Law Group, Inc.

(57) ABSTRACT

An LED lamp includes an LED and a lens covering thereon. The LED has an optical axis. The lens includes a light incidence surface adjacent to the LED and a light emission surface opposite to the light incidence surface. A first imaginary plane and a second imaginary plane intersect at the optical axis of the LED, the light emission surface of the lens is symmetric about the first and second imaginary planes, respectively. In the first imaginary plane, light emitted from the light emission surface distribute regions which a light emitting angle of the LED lamp ranges from 0° to about 45°. In the second imaginary plane, light emitted from the light emission surface distribute regions which a light emitting angle of the LED lamp ranges from 0° to about 75°.

18 Claims, 5 Drawing Sheets

LED LAMP INCORPORATING AN ELONGATED LENS USED FOR DIRECTING EMITTED LIGHT WITHIN A PREDETERMINED RANGE OF ANGLES

BACKGROUND

1. Technical Field

The disclosure relates to LED (light emitting diode) lamps and, particularly, to an LED lamp with an improved lens.

2. Description of Related Art

LED lamp, a solid-state lighting, utilizes LEDs as a source of illumination, providing advantages such as resistance to shock and nearly limitless lifetime under specific conditions. Thus, LED lamps present a cost-effective yet high quality replacement for incandescent and fluorescent lamps.

Known implementations of LED lamps in an LED lamp employ lenses for focusing light generated by the LEDs. However, a light pattern provided by such an LED lamp is substantially round, and is not suitable for illuminating a certain location, such as roadway, which has a need to be able to direct light to a middle of the roadway instead of lighting on a region neighboring a roadside of the roadway, such as houses beside the roadway. Apparently, the round light pattern provided by the conventional LED lamp can not satisfy such a requirement.

What is need therefore is an LED lamp which can overcome the above limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
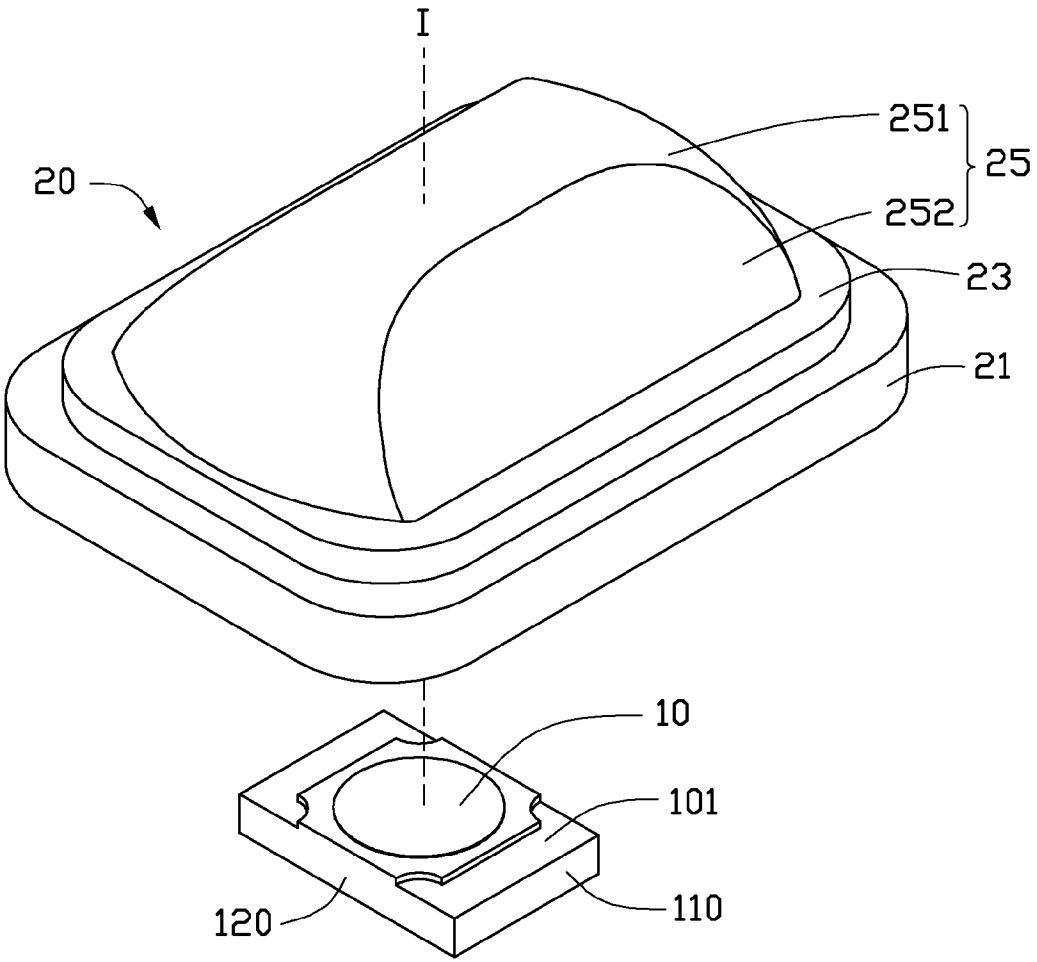
FIG. 1 is an isometric, exploded view of an LED lamp in accordance with an exemplary embodiment of the disclosure.

Referring to FIG. 1, an exemplary embodiment of an LED lamp includes an LED 10 and a lens 20 covering the LED 10. The LED 10 includes at least a semiconductor chip (not shown) and an encapsulation 101 enclosing the semiconductor chip. In the present embodiment, the encapsulation 101 of the LED 10 has a general rectangular structure and includes a pair of end surfaces 110 and a pair of side surfaces 120. The LED 10 has an optical axis I.

Figure 2:
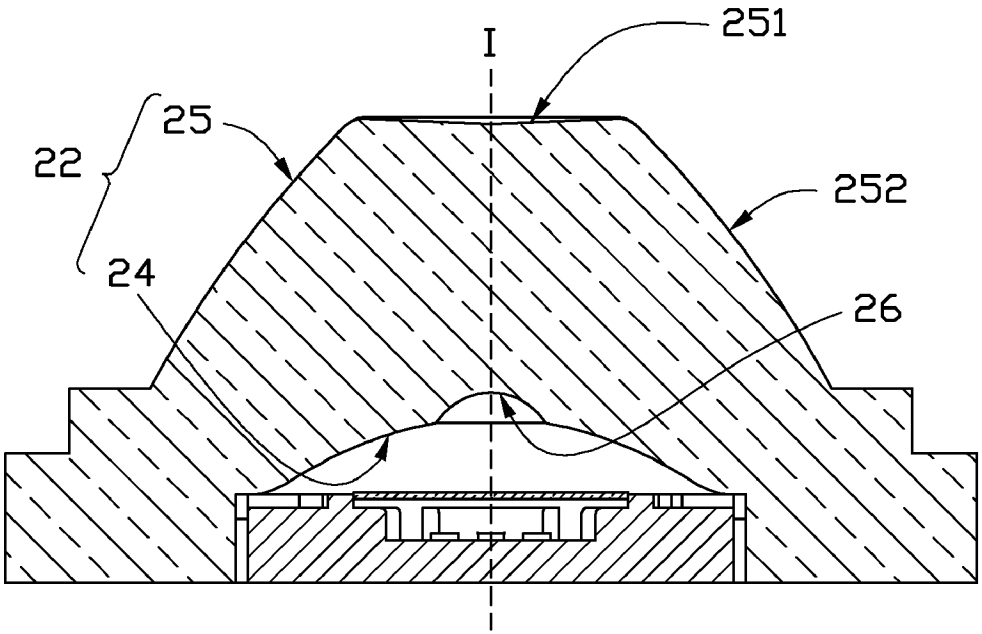
FIG. 2 is a traversal section view of an assembled LED lamp of FIG. 1.
Figure 3:
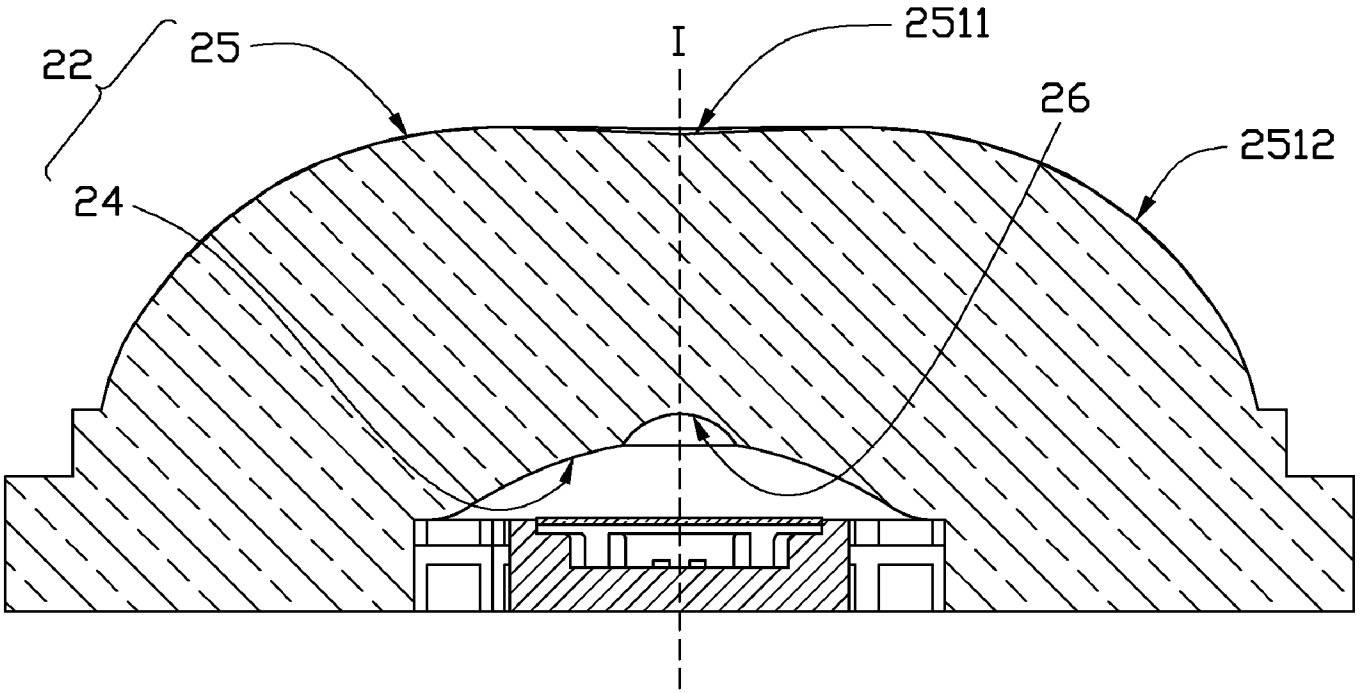
FIG. 3 is a longitudinal section view of the assembled LED lamp of FIG. 1.

Referring also to FIGS. 2-3, the lens 20 is integrally made of a light-transparent material, such as PC (polycarbonate) or PMMA (poly (methyl methacrylate)). The lens 20 includes a supporting base 21, a light guiding member 22 and a connecting member 23 connected between the supporting base 21 and the light guiding member 22.

The supporting base 21 and the connecting member 23 are configured for conveniently securing the lens 20 to a printed circuit board or other structures of a lamp. Thus, structures of the supporting base 21 and the connecting member 23 are not limited. In the present embodiment, the supporting base 21 and the connecting member 23 are rectangular, and a size of the connecting member 23 is less than that of the supporting base 21. The connecting member 23 is formed on the supporting base 21, and the light guiding member 22 extends upwardly from a top side of the connecting member 23. The light guiding member 22 has a general convex profile relative to a combination of the supporting base 21 and the connecting member 23. The supporting base 21, the light guiding member 22 and the connecting member 23 have a common axis being coaxial with the optical axis I of the LED 10.

Figure 4:
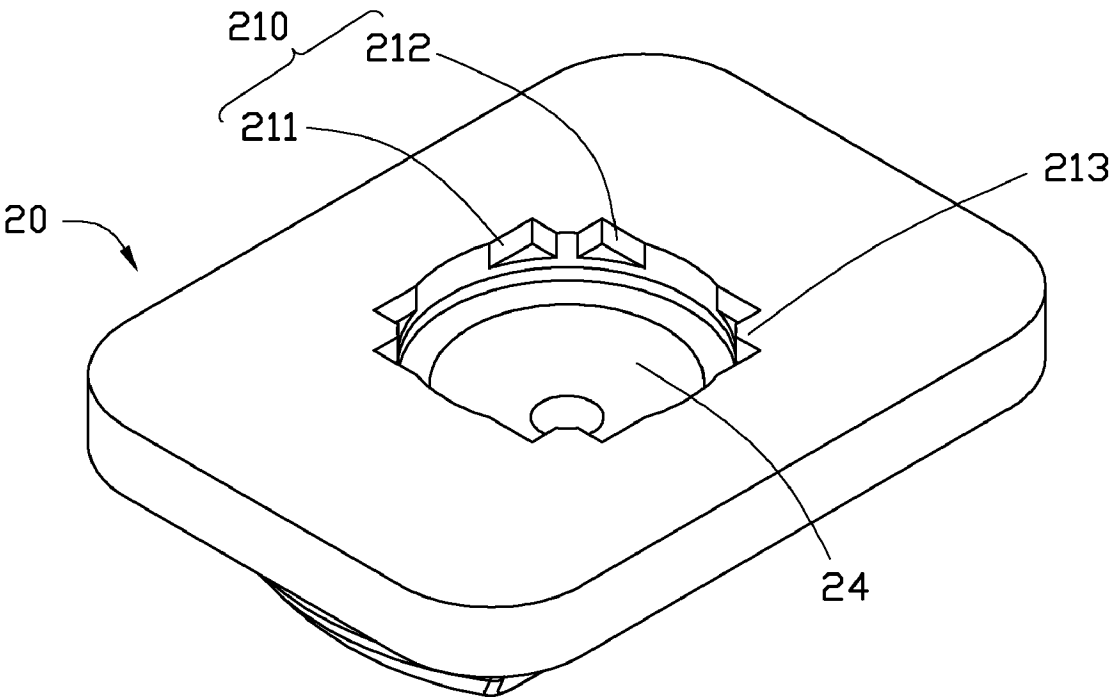
FIG. 4 is an inverted view of a lens of the LED lamp of FIG. 1.

Referring also to FIG. 4, a bottom surface of the supporting base 21 defines a positioning groove 210 for receiving the LED 10. The positioning groove 210 is defined by a pair of long walls 211 and a pair of short wall 212 respectively connecting the long walls 211. A corner of each long wall 211 and a neighboring short wall 212 protrudes inwardly to form a resisting member 213 to abut against the LED 10. A middle portion of each long wall 211 extends outwardly to form a first arced wall, similarly, a middle portion of each short wall 212 extends outwardly to form a second arced wall. The first and second arced walls of the long walls 211 and short walls 212 enable the lens 20 can engage with various LEDs 10 having various profiles. In the present embodiment, when the LED 10 is disposed in the positioning groove 210 of the supporting base 21 of the lens 20, the two end surfaces 110 of the LED 10 abut against two short walls 212 of the positioning groove 210; the two side surfaces 120 of the LED 10 space apart the two long walls 211 of the positioning groove 210; four resisting members 213 abut against the two side surfaces 120 of the LED 10. The two end surfaces 110 of the LED 10 and the two short walls 212 defining the positioning groove 210 of the supporting base 21 can be adhered to each other by a glue, whereby the LED 10 is fixed in the lens 20.

The light guiding member 22 includes a light incidence surface 24 neighboring the LED 10 and a light emission surface 25 opposite to the light incidence surface 24. The light incidence surface 24 connects edges of the long and short walls 211, 212 and extends upwardly relative to the supporting base 21. The LED 10 received in the positioning groove 210 of the supporting base 21 and the light incidence surface 24 are spaced for a certain distance. In the present embodiment, the positioning groove 210 is defined at a central portion of the bottom surface of the supporting base 21. When the LED is received in the positioning groove 210, an axis of the light incidence surface 24 is coaxial with the optical I of the LED 10. In the present embodiment, the light incidence surface 24 is a free-form surface.

When the LED lamp works, the light generated by the LED 10 enters the lens 20 from the light incidence surface 24 and emits out of the lens 20 from the light emission surface 25. The light generated by the LED 10 is adjusted by a combination of the light incidence surface 24 and the light emission surface 25 to form a suitable light pattern. In order to clearly describe a structure of the light emission surface 25 of the light guiding member 22, a first imaginary plane and a second imaginary are defined. The first and second imaginary planes perpendicularly intersect at the optical axis I of the LED 10. The first imaginary plane is coplanar with a transversal section surface of the lens 20 passing through the center of the lens 20; the second imaginary plane is coplanar with a longitudinal section surface passing through the center of the lens 20. The light emission surface 25 is symmetric about the first and second imaginary planes, respectively, whereby the light emitted from the light emission surface 25 has a pattern being symmetrical relative to the first and second imaginary planes, respectively.

The light emission surface 25 includes a free-form surface 251 and two ellipsoid surfaces 252 arranged at left and right sides (along a widthwise direction of the lens 20) of the free-form surface 251. The free-form surface 251 is an axially symmetric curved surface. That is, the free-form surface 251 is symmetric about the first and second imaginary planes, respectively. A width of the free-form surface 251 gradually decreases from front and back ends (along a lengthwise direction of the lens 20) of the light emission surface 25 to a middle portion of the light emission surface 25. As shown in FIG. 3, the free-form surface 251 includes a central concave arc section 2511 and two convex arc sections 2512 connected with two ends of the concave arc section 2511.

The two ellipsoid surfaces 252 are symmetric about the free-form surface 251. Each of the two ellipsoid surfaces 252 includes a straight edge connecting with the connecting member 23 and a curved edge connecting with edges of the concave arc section 2511 and two convex arc sections 2512 of the free-form surface 251. A width of each ellipsoid surface 252 (i.e., a distance between the straight edge and the curved edge of each ellipsoid surface 252) gradually increases first and then gradually decreases from its front and back ends (along the lengthwise direction of the lens 20) to its middle portion.

To obtain a further reasonable light pattern, a central portion of the light incidence surface 24 extends upwardly a concave surface 26. The concave surface 26 can be a spherical surface or a free-form surface. In an alternative embodiment, to optimize the light pattern of the LED lamp, the axis of the light incidence surface 24 is not coaxial with the optical axis I of the LED 10.

Figure 5:
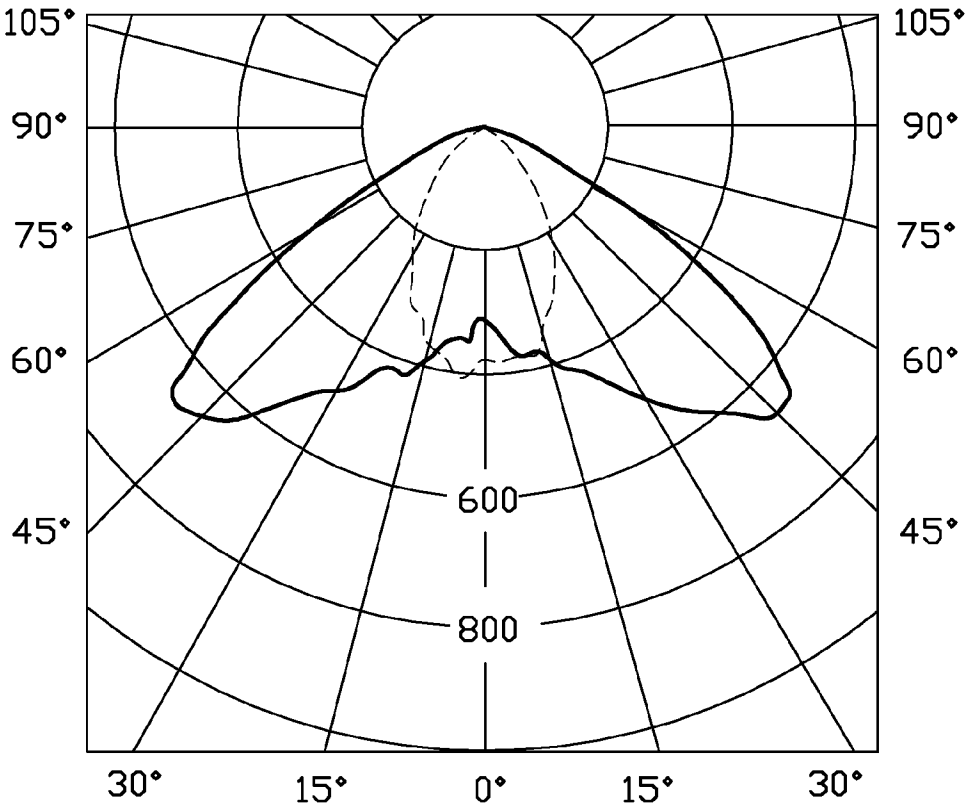
FIG. 5 is a graph showing angular distribution of luminous intensities of a light of the LED lamp of FIG. 1.

FIG. 5 illuminates a distribution curve of luminous intensity of a combination of the LED 10 and the lens 20, which includes a dotted curve and a solid curve. In a practical measuring system, the first and second imaginary planes are defined to measure an angular distribution of luminous intensity of the light of the LED lamp. The dotted curved indicates the angular distribution of luminous intensity of the light of the LED lamp in the first imaginary plane, i.e., showing the angular distribution of luminous intensity of the light emitted from the free-form surface 251 of the light emission surface 25. The solid curve indicates the angular distribution of luminous intensity of the light of the LED lamp in the second imaginary plane, i.e., showing the angular distribution of luminous intensity of the light emitted from the two ellipsoid surfaces 252 of the light emission surface 25.

Due to the free-form surface 251 of the light emission surface 25 being symmetric about the optical axis I of the LED lamp, the light of the LED 10 emitted from the free-form surface 251 form a light pattern being symmetric relative to the optical I of the LED 10. The light pattern is distributed in a range of the light emitting angle from 0° to about 45°. With the light emitting angle of the LED lamp increase from 0° to 15°, the luminous intensity of the LED lamp is same or has a small change. With the light emitting angle of the LED lamp increase from 15° to 45°, the luminous intensity of the LED lamp decreases gradually. In sum, in the first imaginary plane, the light emitted from the light emission surface 25 distribute regions which the light emitting angle of the LED lamp ranges from 0° to about 45°. In the first imaginary plane, a luminous intensity of the LED lamp where the light emitting angle of the LED lamp ranges from 0° to about 15° is larger than the luminous intensity of the LED lamp where the light emitting angle of the LED lamp ranges from 15° to about 45°.

Because the two ellipsoid surfaces 252 are symmetric about the optical axis I of the LED lamp, the light beams of the LED 10 emitted from the two ellipsoid surfaces 252 form a symmetrical wing-shaped light pattern being symmetric relative to the optical I of the LED 10. The light pattern is distributed in a range of the light emitting angle from 0° to about 75°. With the light emitting angle of the LED lamp increase from 0° to 45°, the luminous intensity of the LED lamp increases accordingly. With the light emitting angle of the LED lamp increase from 45° to 75°, the luminous intensity of the LED lamp decreases gradually. In sum, in the second imaginary plane, light emitted from the light emission surface 25 distribute regions which the light emitting angle of the LED lamp ranges from 0° to about 75°.

The LED lamp can be used for road illumination, and the LED lamp is installed according to a practical illumination requirement. For example, the lengthwise direction of the LED lamp is perpendicular to a widthwise direction of the road, then the light emitted from the free-form surface 251 illuminates the width region of the road below the LED lamp; the light emitted from the two ellipsoid surfaces 252 illuminate the length region of the road below the LED lamp. In the lengthwise direction of the road, the LED lamp has a relatively wider light emitting angle, i.e., from 0° to about 75°; in the widthwise direction of the road, the LED lamp has a relatively narrower light emitting angle, i.e., from 0° to about 45°. Thus, the light of the LED lamp can be effectively used.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. An LED lamp comprising:

an LED having an optical axis;

a lens covering the LED, the lens comprising a light incidence surface adjacent to the LED, a light emission surface opposite to the light incidence surface;

wherein a first imaginary plane and a second imaginary plane intersect at the optical axis of the LED, the light emission surface of the lens is symmetric about the first and second imaginary planes, respectively; in the first imaginary plane, light emitted from the light emission surface distribute regions which a light emitting angle of the LED lamp ranges from 0° to about 45°; in the second imaginary plane, light emitted from the light emission surface distribute regions which a light emitting angle of the LED lamp ranges from 0° to about 75°; and wherein in the second imaginary plane, the luminous intensity of the LED lamp decreases gradually with the light emitting angle of the LED lamp increasing from 45° to 75°.

2. The LED lamp of claim 1, wherein in the first imaginary plane, a luminous intensity of the LED lamp where the light emitting angle of the LED lamp ranges from 0° to about 15° is larger than the luminous intensity of the LED lamp where the light emitting angle of the LED lamp ranges from 15° to about 45°.

3. The LED lamp of claim 2, wherein with the light emitting angle of the LED lamp increase from 0° to 15°, the luminous intensity of the LED lamp is same or has a small change.

4. The LED lamp of claim 2, wherein with the light emitting angle of the LED lamp increase from 15° to 45°, the luminous intensity of the LED lamp decreases gradually.

5. The LED lamp of claim 1, wherein in the second imaginary plane, with the light emitting angle of the LED lamp increase from 0° to 45°, the luminous intensity of the LED lamp increases accordingly.

6. The LED lamp of claim 1, wherein the light emission surface comprises a free-form surface and two ellipsoid surfaces arranged at left and right sides of the free-form surface.

7. The LED lamp of claim 6, wherein the free-form surface is an axially symmetric curved surface and is symmetric about the first and second imaginary planes, respectively.

8. The LED lamp of claim 7, wherein the free-form surface comprises a central concave arc section and two convex arc sections connected with two ends of the concave arc section.

9. The LED lamp of claim 8, wherein a width of the free-form surface gradually decreases from front and back ends of the light emission surface to a middle portion of the light emission surface.

10. The LED lamp of claim 6, wherein the two ellipsoid surfaces are symmetric about the free-form surface.

11. The LED lamp of claim 1, wherein the lens further comprises a supporting base and a light guiding member extending upwardly from the supporting base, a bottom surface of the supporting base defines a positioning groove receiving the LED, an inner surface of the light guiding member is the light incidence surface of the lens which defines the position groove of the supporting base, an outer surface of the light guiding member is the light emission surface of the lens.

12. The LED lamp of claim 11, wherein the light guiding member has a general convex profile relative to the supporting base.

13. An LED lamp comprising:

an LED having an optical axis;

an elongated lens covering the LED, the lens comprising a light incidence surface adjacent to the LED, a light emission surface opposite to the light incidence surface, the light emission surface having an axis being coaxial with the optical axis of the LED;

wherein the light emission surface comprises a free-form surface and two ellipsoid surfaces symmetrically arranged two sides of the free-form surface, the light of the LED emitted from the free-form surface distribute regions which a light emitting angle of the LED lamp ranges from 0° to about 45°; the light of the LED emitted from the two ellipsoid surfaces distribute regions which the light emitting angle of the LED lamp ranges from 0° to about 75°; and wherein with the light emitting angle of the LED lamp increasing from 45° to 75°, the luminous intensity of the light of the LED emitted from the two ellipsoid surfaces decreases gradually.

14. The LED lamp of claim 13, wherein the free-form surface is symmetric about optical axis of the LED.

15. The LED lamp of claim 13, wherein a luminous intensity of the light of the LED emitted from the free-form surface ranging from 0° to about 15° is larger than that of the light of the LED emitted from the free-form surface ranging from 15° to about 45°.

16. The LED lamp of claim 15, wherein with the light emitting angle of the LED lamp increase from 0° to 15°, the luminous intensity of the light of the LED emitted from the free-form surface is same or has a small change.

17. The LED lamp of claim 16, wherein with the light emitting angle of the LED lamp increase from 15° to 45°, the luminous intensity of the light of the LED emitted from the free-form surface decreases gradually.

18. The LED lamp of claim 13, wherein with the light emitting angle of the LED lamp increase from 0° to 45°, the luminous intensity of the light of the LED emitted from the two ellipsoid surfaces increases accordingly.

* * * * *